US007289759B2

(12) United States Patent
Ogura

(10) Patent No.: US 7,289,759 B2
(45) Date of Patent: Oct. 30, 2007

(54) CLEANING APPARATUS

(75) Inventor: Motohiro Ogura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 130 days.

(21) Appl. No.: 11/206,267

(22) Filed: Aug. 18, 2005

(65) Prior Publication Data

US 2006/0045593 A1 Mar. 2, 2006

(30) Foreign Application Priority Data

Aug. 27, 2004 (JP) ..... 2004-247951

(51) Int. Cl.
*G03G 21/00* (2006.01)

(52) U.S. Cl. ..... 399/350; 399/351

(58) Field of Classification Search ..... 399/350, 399/351, 343, 99, 100, 101, 326; 15/1.51, 15/256.5, 256.51, 256.52
See application file for complete search history.

(56) References Cited

U.S. PATENT DOCUMENTS 4,639,123 A * 1/1987 Adachi et al. ..... 399/351
6,721,533 B2 * 4/2004 Sato et al. ..... 399/350
7,184,674 B2 * 2/2007 Satoh et al. ..... 399/350 X
2005/0254868 A1 * 11/2005 Naruse et al. ..... 399/350

FOREIGN PATENT DOCUMENTS

| | | | |
|---|---|---|---|
| JP | 60-12569 | | 1/1985 |
| JP | 01-235986 | A * | 9/1989 |
| JP | 05-046057 | A * | 2/1993 |
| JP | 05-273897 | A * | 10/1993 |
| JP | 08-335016 | A * | 12/1996 |
| JP | 3087230 | | 7/2000 |
| JP | 2001-75452 | | 3/2001 |

* cited by examiner

*Primary Examiner*—Sophia S. Chen
(74) *Attorney, Agent, or Firm*—Fitzpatrick, Cella, Harper & Scinto

(57) ABSTRACT

A cleaning apparatus in which the contact point portion between the metal plate and rubber blade of a cleaning blade is made into a surface to thereby alleviate the concentration of stress in that portion and prevent the occurrence of the squat of the cleaning blade, and high cleaning performance can be maintained for a long period. In the cleaning apparatus provided with a cleaning blade 22 including a rubber blade 3*d* adhesively secured to or molded integrally with a metal plate 31, an elastic layer 3*c* is provided on the distal end portion of the metal plate 31 of the cleaning blade, and the elastic layer 3*c* supports a surface opposite to that surface of the cleaning blade which contacts with a drum, together with the metal plate.

16 Claims, 6 Drawing Sheets

CLEANING APPARATUS

BACKGROUND OF THE INVENTION

1. Field of the Invention

This invention relates to a cleaning apparatus for cleaning the surface of the image bearing member of an image forming apparatus such as a printer, a copying machine or a facsimile apparatus.

2. Related Background Art

As a cleaning apparatus provided in an image forming apparatus such as a printer, a copying machine or a facsimile apparatus, there is known one having a cleaning blade as a cleaning member for cleaning an image bearing member.

For example, in an image forming apparatus adopting an electrophotographic process, a toner image is formed on a photosensitive drum (image bearing member) by way of image forming processes such as a charging process, an exposing process and a developing process, and this toner image is transferred from the photosensitive drum onto a recording material (e.g. paper) and an intermediate transferring member (a belt or the like) by a transferring process. In this transferring process, a toner constituting the toner image on the photosensitive drum is not all transferred to the recording material, but a small amount of toner is residual on the surface of the photosensitive drum (this also holds true in the case of the intermediate transfer member to the paper). The toner residual on the surface of the photosensitive drum (hereinafter referred to as the "residual toner") in this manner is removed by the aforementioned cleaning blade.

In recent years, electrophotographic apparatuses have also been strengthening the tendency toward coloring and at the same time, toward a smaller apace and a lower cost. On the other hand, in spite of higher performance being required of a cleaning blade, it is popular to contrive to meet the required performance by a fixed method using only a cleaning blade without using conventional cleaning auxiliary members (such as a spring, an equalizer, a reciprocator and a fur brush).

As a method of fixing the conventional cleaning blade, there is generally known a centrifugal forming method of making rubber into a strip and adhesively securing this to a metal plate, as what can cope with various materials and moreover, can realize a lower cost (see, for example, Japanese Patent No. 3087230).

In a case where as described above, the strip-shaped rubber is adhesively secured to the metal plate to thereby fix the cleaning blade, if the blade is brought into contact with the drum for a long period, there will arise the problem that even if the blade is spaced apart from the drum, the shape of the blade does not recover the original shape, but remains permanently deformed into the curved shape when the blade was in contact with the drum (hereinafter referred to as the squat). If the blade is thus permanently deformed, it will become impossible to apply pressure necessary for cleaning to the photosensitive drum, thus resulting in faulty cleaning. The main cause of this has generally been said to be the influence of an adhesive agent layer (see, for example, Japanese Patent Application Laid-open No. 2001-75452).

Also, Japanese Patent Application Laid-open No. S60-12569 discloses that in a cleaning apparatus wherein a blade and a holding member for supporting the blade are adhesively secured to each other, the distal end surface of the holding member and that surface of the blade which is adjacent to the holding member are secured to each other by an adhesive agent in order to prevent the blade from peeling from the holding member. It also describes that as the adhesive agent, use may be made of a rubber-like adhesive agent or an adhesive agent of a hardening type such as urethane.

However, regarding the problem of the squat of the cleaning blade in the case where the strip-shaped rubber is adhesively secured to the metal plate to thereby fix the cleaning blade, it has been found that the cause of the problem is not only the influence of the adhesive agent layer, but the influence of the construction of the cleaning blade is greater. That is, it has been found that when pressure is applied to the distal end of the cleaning blade, stress becomes a fulcrum at the point of contact between the metal plate and the rubber portion, and by that force, squat is caused to the cleaning blade. Also, in the construction of Japanese Patent Application Laid-open No. S60-12569, the blade is held by being adhesively secured to the holding member, but the adhesively secured surface between the blade and the holding member is held from that surface of the plate-shaped blade which is adjacent to the drum (the outer side of the cleaning apparatus). Thus, no elastic member is provided in a direction in which the distal end of the blade is deformed when the blade contacts with the drum and therefore, the squat cannot be prevented by the adhesive agent provided on the distal end portion of the holding member. Also, this publication lacks the detailed description of the specific shape and physical property value of the adhesive agent provided on the distal end portion of the blade holding member, and does not disclose specific description for preventing the squat of the blade as in the present invention. Also, the adhesive agent provided on the distal end of the holding member is a liquid-like (rubber-like) adhesive agent hardened. Therefore, it is difficult to secure the accuracy of the shape of the adhesive agent, and this leads to the problem that depending on the shape of the adhesive agent, the cleaning property is lowered.

Also, in a case where with various requirements taken into account, various rubber materials are used for the cleaning blade, the use range of the rubber materials is limited in the case of a construction in which the influence of the adhesive agent must be considered.

SUMMARY OF THE INVENTION

The present invention has been made in view of the above-noted problems, and the object thereof is to provide a cleaning apparatus in which the contact point portion between a cleaning blade and a supporting member is made into a surface to thereby alleviate the concentration of stress in that portion, and the occurrence of the squat of the cleaning blade can be prevented to thereby maintain high cleaning performance of a long period.

DESCRIPTION OF THE PREFERRED EMBODIMENTS

Figure 1:
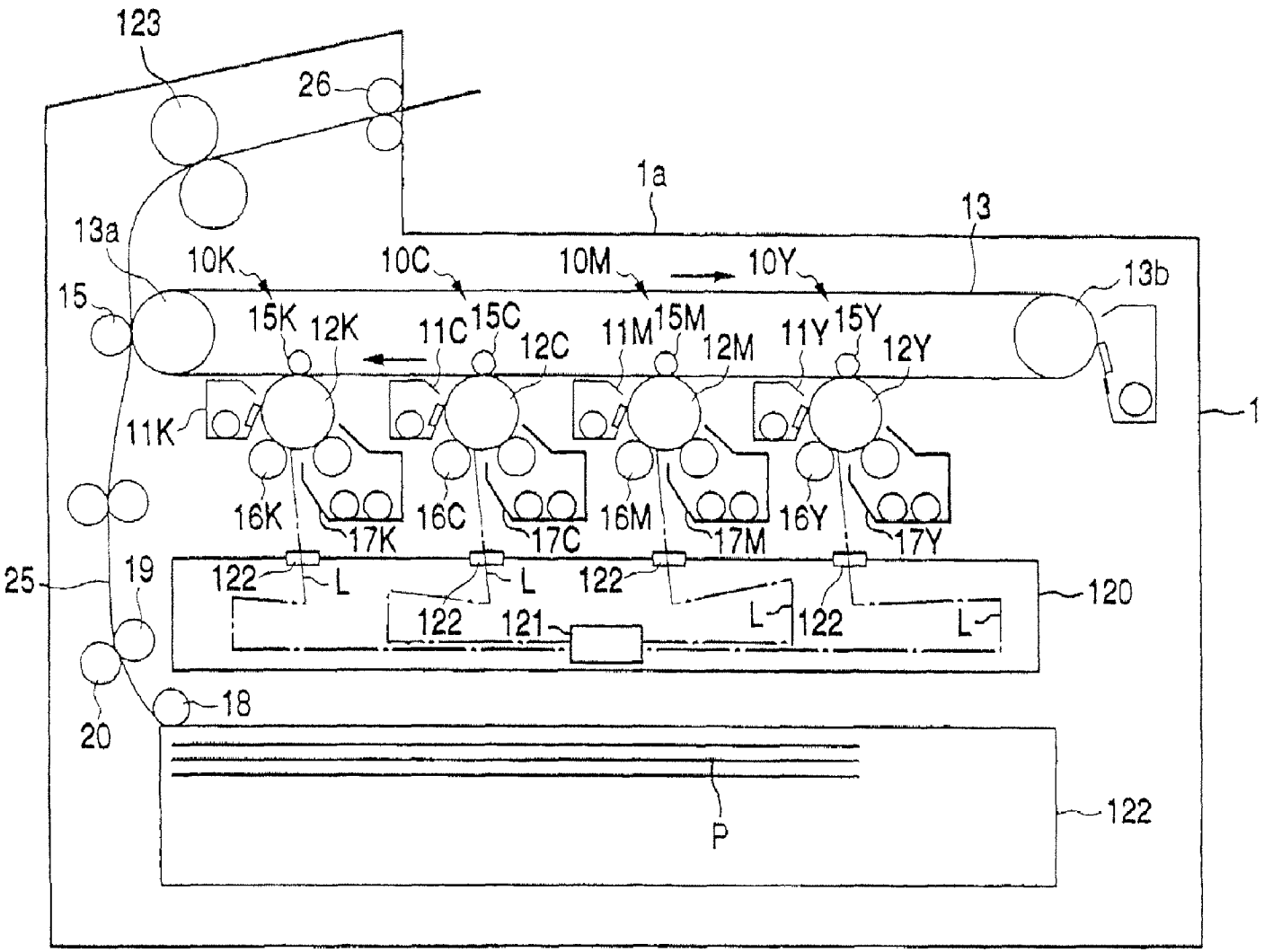
FIG. 1 is cross-sectional view schematically showing the construction of an image forming apparatus according to the present invention.

Some embodiments of the present invention will hereinafter be described with reference to the drawings. Throughout the drawings, like reference characters designate members of like construction or action, and the duplicate description thereof will be suitably omitted.

Embodiment 1

(1) Image Forming Apparatus

Before describing a cleaning apparatus according to the present invention, description will first be simply made of the general construction and function of an image forming apparatus provided with the same. FIG. 1 is a longitudinal cross-sectional view of the image forming apparatus provided with the cleaning apparatus according to the present invention, and the shown image forming apparatus is a laser beam printer. While description will hereinafter be made with respect to a case where the object to be cleaned by the cleaning apparatus according to the present invention as a photosensitive drum, the present invention is also effective for a cleaning apparatus for cleaning an intermediate transferring member such as an intermediate transferring drum or an intermediate transferring belt.

The laser beam printer shown in FIG. 1 is provided with four process units 10Y, 10M, 10C and 10K for forming yellow, magenta, cyan and black toner images, respectively, is provided with an intermediate transferring belt 13 to which the toner images are primary-transferred from the respective process units 10Y, 10M, 10C and 10K, and is designed such that the toner images multiplexly transferred to this intermediate transferring belt 13 are secondary-transferred to a recording sheet P to thereby form a full-color image.

The intermediate transferring belt 13 is formed into an endless shape and is passed over a pair of belt conveying rollers 13*a* and 13*b*, and is designed to be moved round in the direction of arrow and receive the primary transfer of the toner images formed in the process units 10Y, 10M, 10C and 10K of the respective colors. Also, a secondary transfer roller 15 is disposed at a location opposed to one belt conveying roller 13*a* with the intermediate transferring belt 13 interposed therebetween, and the recording sheet P is inserted into between the secondary transfer roller 15 and the intermediate transfer belt 13 brought into pressure contact with each other, and receives the secondary transfer of the toner images from the intermediate transferring belt 13.

Also, the aforementioned process units 10Y, 10M, 10C and 10K are juxtaposed under the intermediate transfer belt 13 so that the toner images formed in conformity of image information of the respective colors may be primary-transferred to the intermediate transferring belt 13. These four process units 10Y, 10M, 10C and 10K are disposed in the order of yellow, magenta, cyan and black along the direction of rotation of the intermediate transferring belt 13, and the black process unit 10K considered to be used most frequently is disposed at a location nearest to a secondary transferring position.

Also, below these process units 10Y, 10M, 10C and 10K, there is disposed a raster scanning unit 120 for exposing photosensitive drums 12 (12Y, 12M, 12C, 12K) installed in the respective process units 10Y, 10M, 10C and 10K in conformity with the image information. This raster scanning unit 120 is used in common for all of the process units 10Y, 10M, 10C and 10K, and is provided with four semiconductor lasers (not shown) emitting laser beams L modulated in conformity with the image information of the respective colors, and a polygon mirror 121 rotated at a high speed to thereby scan these four laser beams L along the axial direction of the photosensitive drums 12. The laser beams L scanned by the polygon mirror 121 travel along predetermined routes while being reflected by mirrors (not shown), and expose the photosensitive drums 12 of the respective process units 10Y, 10M, 10C and 10K thereto through a scanning window 122 provided in the upper portion of the raster scanning unit 120.

Also, the respective process units 10Y, 10M, 10C and 10K are provided with the photosensitive drums 12, charging rollers 16Y, 16M, 16C, 16K for charging the photosensitive drums 12 to uniform background portion potential, developing apparatuses 17Y, 17M, 17C, 17K for developing electrostatic latent images formed on the photosensitive drums 12 by the exposure to the laser beams L to thereby form toner images, and cleaning apparatuses 11 (11Y, 11M, 11C, 11K) for removing any residual toners and paper dust from the surfaces of the photosensitive drums 12 after the toner images have been transferred to the recording sheet P, and are designed to be capable of forming toner images conforming to the image information of the respective colors on the photosensitive drums 12.

(2) Cleaning Apparatus

Figure 2:
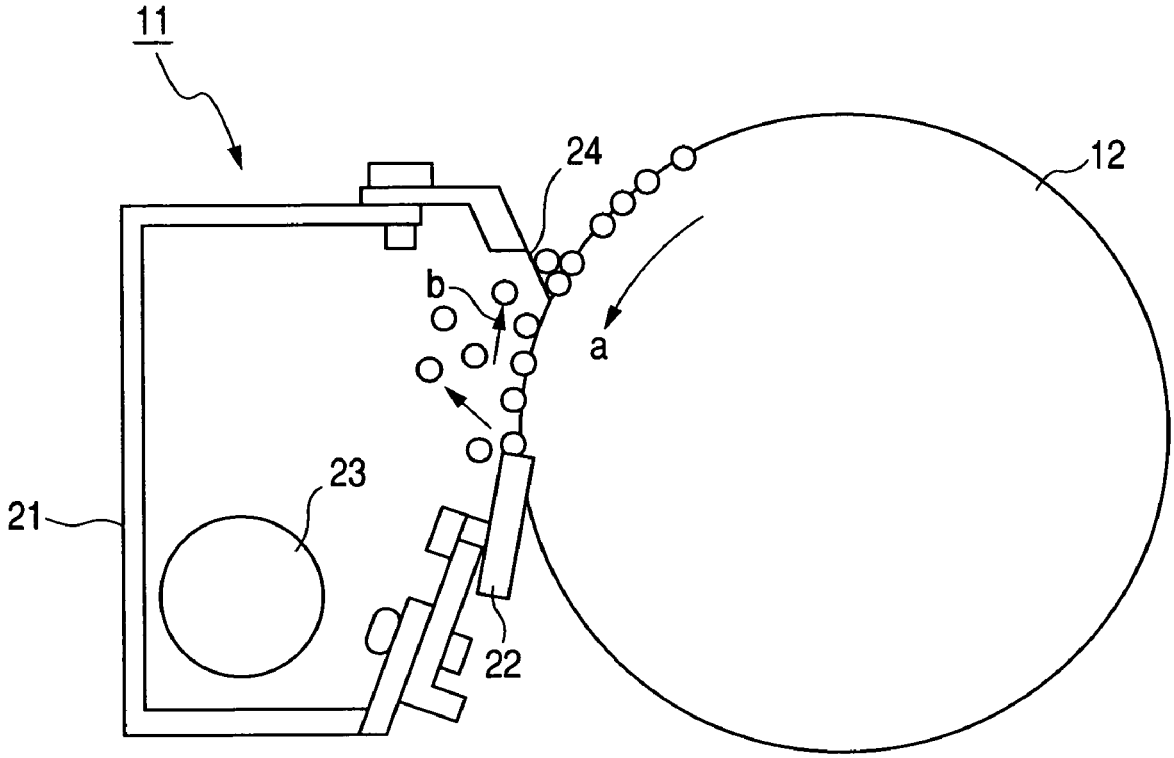
FIG. 2 is a cross-sectional view schematically showing the construction of a cleaning apparatus according to the present invention.

The details of the cleaning apparatus 11 will now be described with reference to FIG. 2. FIG. 2 is a longitudinal cross-sectional view schematically showing the construction of the cleaning apparatus 11.

The cleaning apparatus 11 is constituted by a frame member 21, a cleaning blade (cleaning member) 22, a waste toner carrying screw 23 and a scatter preventing sheet 24. The photosensitive drum 12 is rotated in the direction of arrow a, and the cleaning blade 22 is constituted by a plate-shaped elastic member, is fixed to the lower portion of the frame member 21, is located below the photosensitive drum 12 and is upwardly installed, and the distal end thereof is in contact with the outer peripheral surface of the photosensitive drum 12. Also, the scatter preventing sheet 24 is installed upstream of the cleaning blade 22 with respect to the direction of rotation of the photosensitive drum 12, and is in contact with the photosensitive drum 12 so that the toner scraped off by the cleaning blade 22 may not scatter in the direction of arrow b.

(3) Cleaning Blade

The details of the construction of the cleaning blade 22 will now be described with reference to FIG. 3.

Figure 3:
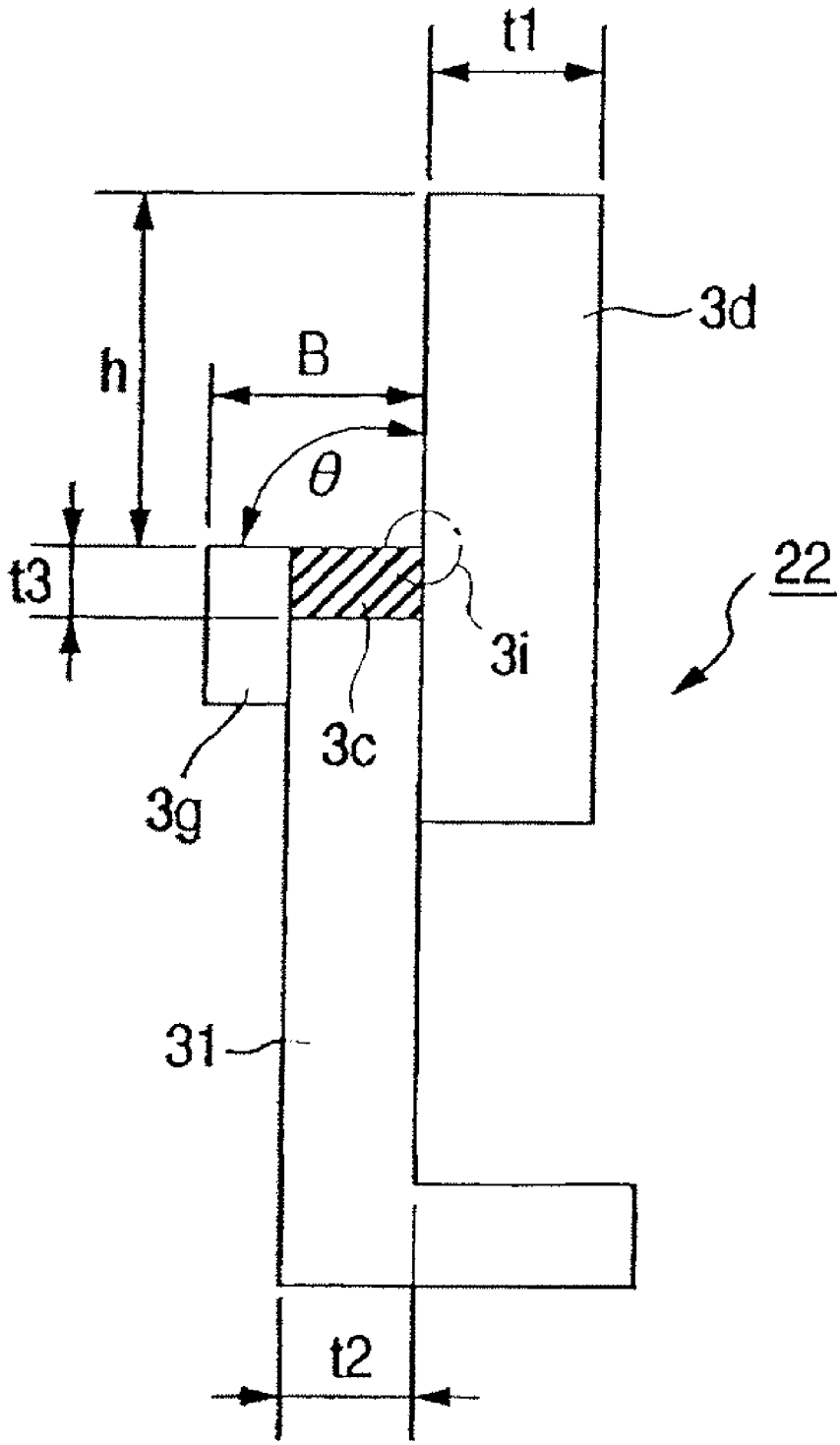
FIG. 3 is a cross-sectional view showing the construction of a cleaning blade according to the present invention.

FIG. 3 is a cross-sectional view showing the construction of the cleaning blade 22, and as shown in FIG. 3, in the cleaning blade 22, a strip-shaped rubber blade 3*d* is stuck on the upper portion of a metal plate 31 which is a supporting member for supporting the cleaning blade 22. The cleaning blade 22, as shown in FIG. 3, has its surface opposite to the surface thereof contacting with the drum supported by the metal plate 31. As the material of the rubber blade 3*d*, use can be made of any material having moderate elasticity and hardness, e.g. elastomer such as polyurethane, styrene-butadiene copolymer, chloroprene, butadiene rubber, ethylene-propylene-diene rubber, chlorosulfonated polyethylene rubber, fluorine rubber, silicone rubber, acryl rubber, nitrile rubber or chloroprene rubber. Particularly preferable is polyurethane having such a degree of elasticity as does not injure the photosensitive drum 12 by friction, and exhibiting high wear resistance. With small permanent distortion taken into account, use is sometimes made of a double fluid thermosetting type polyurethane material. As a hardening agent, use can be made of a popular urethane hardening agent such as 1,4-butanediol, 1,6-hexanediol, hydroquinone-diethylolether, bisphenol A, trimethylolpropane or trimethylolethane.

The thickness t1 of the strip-shaped rubber blade 3*d* as the blade for cleaning is usually 1.5 mm-4 mm, and preferably 1.5 mm-3 mm. If the thickness t1 of the rubber blade 3*d* is smaller than 1.5 mm, the pressure displaying the cleaning performance becomes unobtainable. Also, if the thickness t1 of the rubber blade 3*d* exceeds 4 mm, the pressure becomes too high and at the same time, the flexibility as a rubber material is lost and the follow-up property to the object to be cleaned is lost. Also, the free length h of the strip-shaped rubber blade 3*d* is 3-15 mm, and preferably 5-12 mm. Also, if the free length h of the rubber blade 3*d* is shorter than 3 mm, the flexibility as rubber is lost and the follow-up property to the object to be cleaned is lost. Also, if the free length h of the rubber blade 3*d* is longer than 15 mm, the pressure displaying the cleaning performance becomes difficult to obtain.

Description will now be made of the elastic layer of the distal end portion (distal end rubber layer) 3*c* of the metal plate 31 as an elastic member constituting the gist of the present embodiment.

This elastic layer 3*c* as the elastic member is provided on the joint portion with the metal plate 31 (the vicinity of the distal end portion of the metal plate) on a side opposite to that surface of the blade which contacts with the image-bearing member.

As the material of the elastic layer 3*c*, use can be made of a material basically identical with or of the same origin as the material of the rubber blade 3*d*, and further it is possible to dare to change the material. A material of the same origin as the material of the rubber blade 3*d* is excellent in adhesiveness, but may sometimes cause some squat relative to the rubber blade 3*d* which is great in permanent distortion (influence of 1 to 2% of the total). However, it is not an amount which lowers the effect of the present invention.

When a material differing from the material of the rubber blade 3*d* is used as the material of the elastic layer 3*c*, it is somewhat inferior from the viewpoint of adhesive securing, but a resin material having a characteristic which can better the squat of the rubber blade 3*d* can be selected. In the present embodiment, however, it is preferable to attach importance to the adhesive securing (affinity) and use a material of the same origin as the material of the rubber blade.

Also, if a shape uniform in the longitudinal direction of the blade is not obtained as the shape of the elastic layer 3*c*, it is conceivable that the pressure distribution of the blade is disturbed in the longitudinal direction, but the accuracy of the shape can be provided by adopting a construction in which a solid elastic layer 3*c* formed into a predetermined shape in advance is adhessively secured by an adhesive agent. Basically, a resin having elasticity is basic, and the above-described rubber material is not restrictive.

As an index representing elasticity, there is Young's modulus Y. The Young's modulus according to the present invention is 3-12 MPa, and preferably 5-8 MPa. If the Young's modulus is smaller than 3 MPa, the returning force to the rubber blade 3*d* becomes weak, and the return becomes weak relative to squat. Also, if the Young's modulus is greater than 12 MPa, the influence of the permanent deformation of the elastic layer 3*c* itself will now come out.

The width B of this elastic layer 3*c* is preferably 1.6 mm-2.5 mm. If the width B of the elastic layer 3*c* is smaller than 1.6 mm, the squat preventing effect will be weak, and if the width B is greater than 2.5 mm, the apparatus will become bulky. Also, if the width B of the elastic layer 3*c* is made greater than the thickness t2 of the metal plate 31 and a resin layer 3*g* is formed even up to the back side portion of the metal plate 31, it will be more effective for the prevention of squat. This is considered to be owing to the fact that stress locally applied to the boundary 3*i* between the metal plate and the blade adhesively secured to each other is alleviated by the elastic layer portion on the back side of the metal plate. As to the squat of the rubber blade 3*d*, betterment by 2.5 times or more is obtained when the elastic layer 3*c* is formed up to the back side of the metal plate, as compared with a case where the width of the elastic layer 3*c* is smaller than the thickness of the metal plate 31. Here, the Young's modulus was measured in accordance with JIS K6254 (low deformation tensile test). The measuring device used in the test was ORIENTEC STA-1225. The shape of a test piece during the measurement of the Young's modulus was 1 (mm)×1 (mm)×10 (mm) (the length in the tension direction was 10 mm). The above-described shape is preferable as the shape of the test piece, but even if the shape changes, the Young's modulus does not change much and therefore, measurement can also be carried out with other suitable shape than the above-mentioned shape. Of course, however, the above-designated shape is preferable.

The thickness t3 of the elastic layer 3*c* in the free length direction thereof (the direction from the fixed end side toward the free end side of the blade) may preferably be 0.1-1.5 mm. If the thickness t3 of the elastic layer 3*c* is smaller than 0.1 mm, the contact thereof with the rubber blade 3*d* will almost become a point rather than a surface. If the thickness t3 of the elastic layer 3*c* is greater than 1.5 mm, the flexibility of the rubber blade 3*d* itself will be lost and stress becomes liable to concentrate in the contact point 3*c* between the blade 3*d* and the elastic layer 3*c* on the distal end of the metal plate 31, and the dispersion of stress on a surface which is a feature of the present invention becomes difficult to realize. Further, the area over which the blade contacts with the elastic layer 3*c* becomes excessively large, whereby the stress distribution in the blade is changed and it becomes impossible to concentrate the pressure necessary for cleaning in the contact point between the distal end portion of the blade and the drum.

Figure 7:
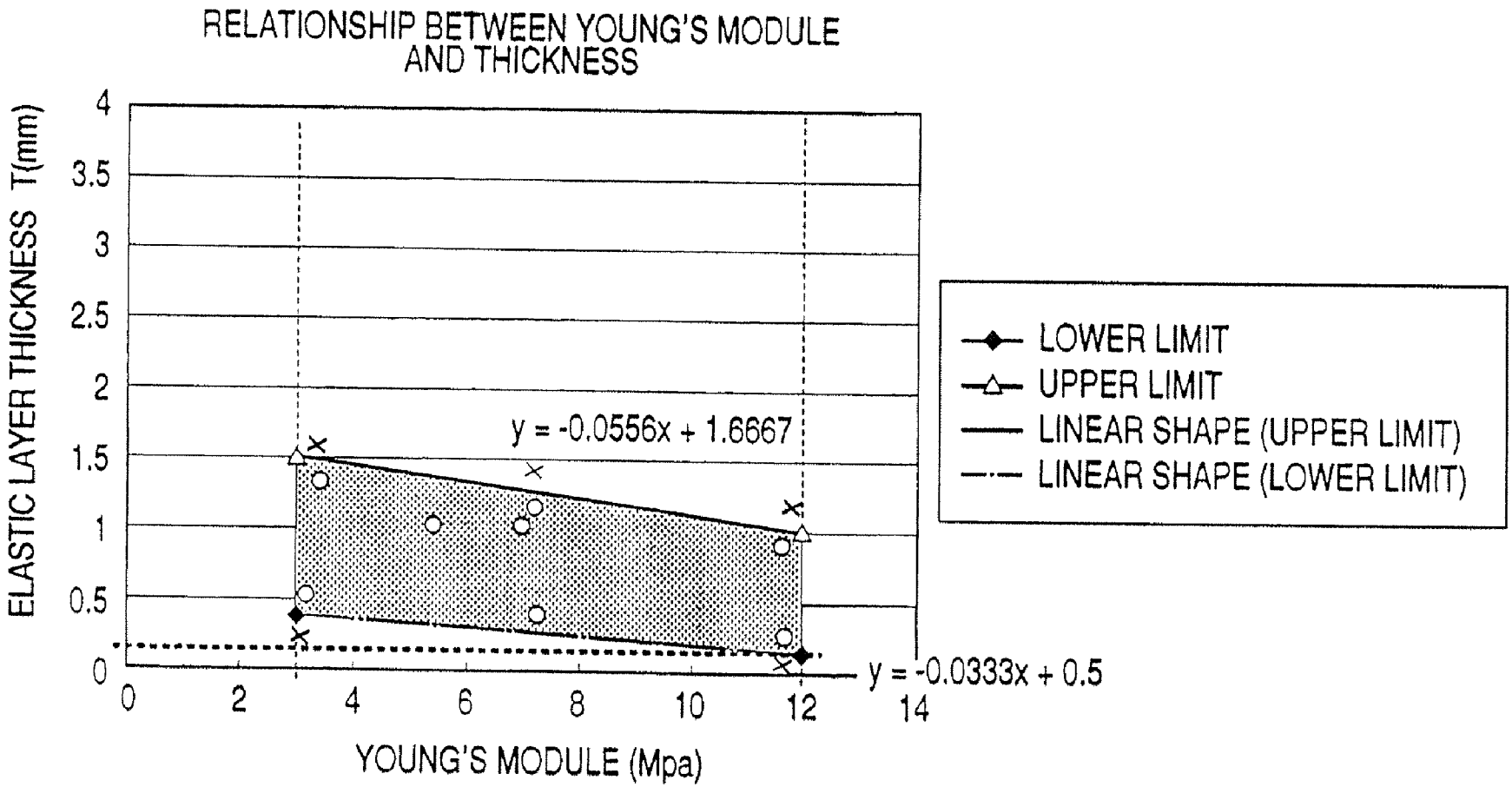
FIG. 7 shows the relationship between the Young's modulus and the thickness in the free length direction of an elastic member according to the present invention.

Also, when the Young's modulus (MPa) of the elastic layer 3*c* is defined as Y and the thickness of the elastic layer 3*c* in the free length direction thereof is defined as length L (mm) according to the experiment carried out by the inventor, when the following relational expression is satisfied, the squat of the rubber blade 3*d* can be prevented and yet, good cleaning performance can be obtained.

$$-0.033Y+0.5 \leqq T \leqq -0.055Y+1.6 \quad (3 \leqq Y \leqq 12) \qquad 1$$

and this corresponds to the hatched portion of FIG. 7. The meaning of the inequality of the left side shows that when the Young's modulus Y of the elastic layer 3*c* is low, the force which returns the deformation of the blade becomes weak and therefore, it is necessary to makes the thickness T (mm) of the elastic layer 3*c* in the free length direction therof correspondingly great. This is considered to be because to prevent squat, it is necessary to moderately work as a spring. On the other hand, as shown in the inequality of the right side, the lenght L (mm) is provided with an upper limit. If this upper limit is exceeded, the entire blade will become thick and the flexibility of the blade itself will be lowered and desired blade contact pressure will become difficult to obtain, and this is effective for the prevention of squat, but the cleaning performance falls. Also, when the Young's modulus is high, it shows that to maintain a good cleaning property, the lenght L (mm) of the elastic layer 3*c* in the free length direction thereof must be small.

The definition of the amount of squat will be described here with reference to FIGS. 4A, 4B, 5A and 5B.

Figure 4A:
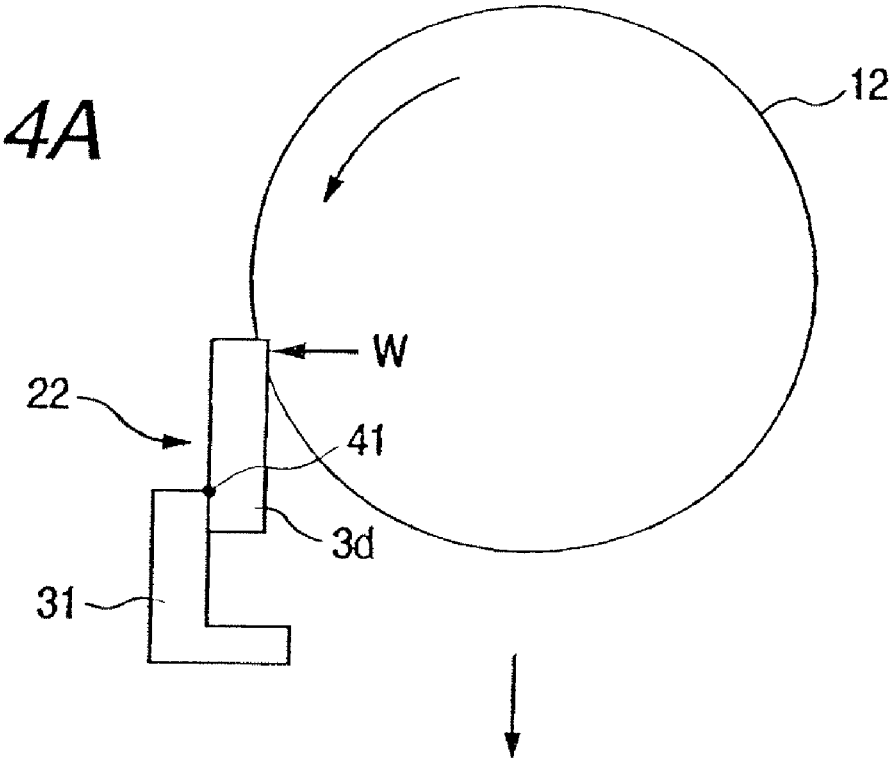
FIGS. 4A and 4B illustrate the amount of squat of the cleaning blade.

The amount of squat refers to the amount of deformation δ of the cleaning blade 22 (see FIG. 4B) when the object to be cleaned is opened (endures) when as shown in FIG. 4A, a certain load W (an amount of entry in a fixed system) is applied to the cleaning blade 22. When for example, the amount of entry is 1.7 mm and after the endurance of 30K in the electrophotographic apparatus, the amount of entry is measured and the value thereof is 1.5 mm, it follows that the cleaning blade was deformed by $(1.7-1.5)\times100/1.7=11.7\%$.

Figure 6:
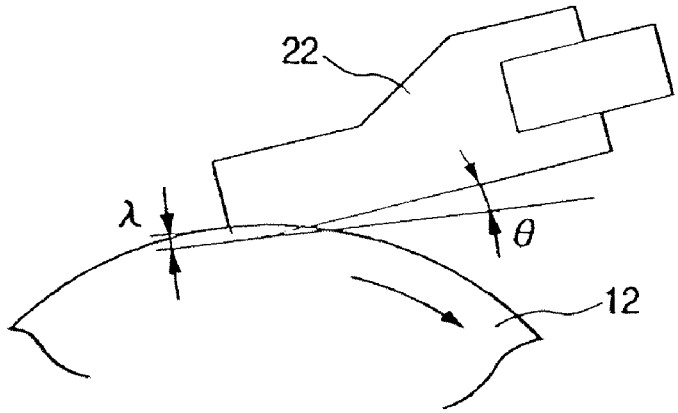
FIG. 6 illustrates the amount of entry λ of the cleaning blade.

Also, the amount of entry λ, as shown in FIG. 6, refers to the depth of entry of the distal end of the cleaning blade 22 (the contact side edge portion of the free end of the cleaning blade 22 which is not deformed) from the imaginary outer periphery of the photosensitive drum 12 in the diametral direction of the photosensitive drum 12 (the amount of entry toward the center of the photosensitive drum 12).

Further, the hitherto described type in which the strip-shaped rubber is adhesively secured to the metal plate and the mechanism of the blade construction of the present invention will be described briefly.

Figure 4B:
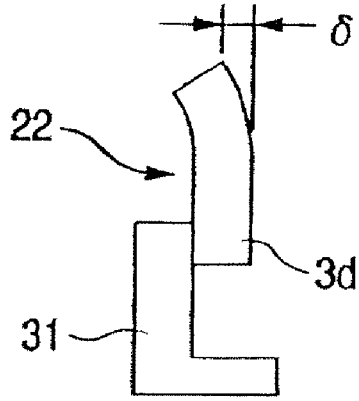
Figure 5A:
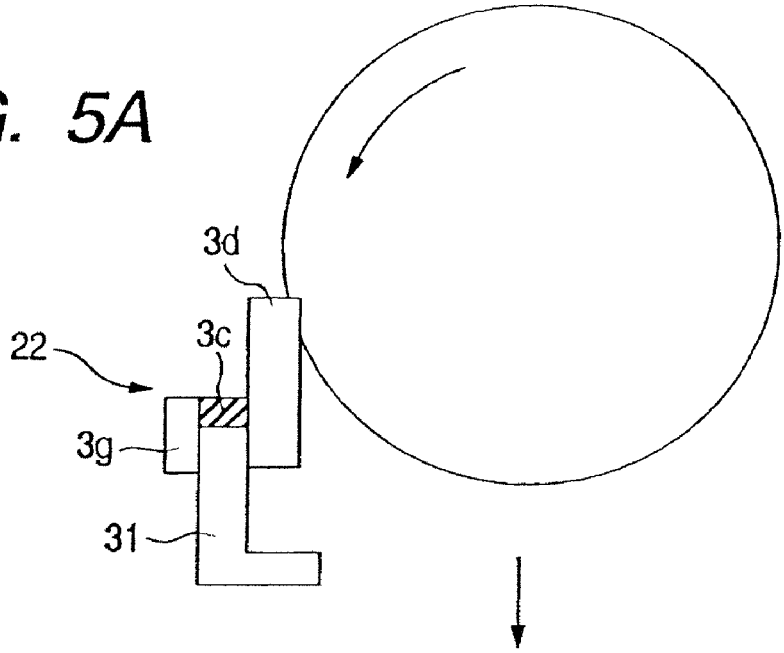
FIGS. 5A and 5B illustrate the effect of the cleaning blade according to the present invention.
Figure 5B:
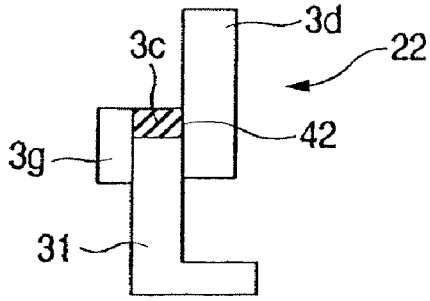

Usually, he cleaning blade 22 is designed to maintain some pressure against the photosensitive drum 12 (FIG. 4A). However, when pressure is concentrated in the distal end of the cleaning blade 22, the contact point portion 41 between the metal plate 31 and the rubber blade 3*d* becomes a fulcrum of force, and stress concentrates therein, and the rubber blade 3*d* is permanently deformed (FIG. 4B). Therefore, the cleaning blade 22 becomes incapable of maintaining pressure necessary for cleaning.

As in the present invention, the elastic layer 3*c* formed of rubber (resin) is provided on the upper portion of the metal plate 31 (FIG. 5A), whereby a fulcrum receiving the pressure against the distal end of the rubber blade 3*d* becomes a surface 42, and the alleviation of the stress occurs and the concentration of the stress does not occur, and the deformation of the rubber blade 3*d* becomes null (FIG. 5B), and the rubber blade 3*d* can forever maintain the pressure necessary for cleaning.

In the present invention, the cleaning blade 22 becomes effective even when the rubber blade 3*d* of the cleaning blade 22 becomes liable to be turned up. That is, it is more effective to dispose the cleaning blade 22 upwardly as shown in FIG. 2. By the cleaning blade 22 being thus upwardly disposed, the toner readily collects on the upper portion of the metal plate 31, whereby the toner readily remains up to the edge portion of the cleaning blade 22. Here, the setting angle θ (contact angle: see FIG. 3) of the rubber blade 3*d* and the elastic layer 3*c* on the upper portion of the metal plate 31 should desirably be 100° or less. If this setting angle θ exceeds 100°, the toner is liable to fall along the inclination and it becomes difficult for the toner to collect.

Description will now be made of the toner regarded as being effective here.

(4) Toner

The toner used for developing the electrostatic latent image in the present embodiment is formed of a color component of yellow or the like, binding resin, aromatic hydrocarbon copolymer petroleum resin of aliphatic hydrocarbon-carbon number 9 or greater, and wax and has a particle diameter of 7 μm.

As the binding resin, use can be made of known resin such as, for example, polyester resin, styrene resin, styrene-(meth)acryl resin, styrene-butadiene resin, epoxy resin or polyurethane resin. Such polyester resin is synthesized from a polyol component and a polycarboxylic acid component by condensation polymerization. As the polyol component used, mention may be made of ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, hydrogenation bisphenol A, bisphenol-A ethylene oxide additive, bisphenol-A propylene oxide additive or the like. As the polycarboxylic acid component, mention may be made of maleic acid, fumaric acid, phthalic acid, isophthalic acid, terephthalic acid, succinic acid, dodecenyl succinic acid, trimellitic acid, pyromellitic acid, cyclohexane tricarboxylic acid, 2,5,7-naphthalene tricarboxylic acid, 1,2,4-naphthalene tricarboxylic acid, 1,2,5-hexane tricarboxylic acid, 1,3-dicarboxyl-2-methylene carboxypropane tetramethylene carboxylic acid or anhydride of those.

Also, the aromatic hydrocarbon copolymerized petroleum resin of aliphatic hydrocarbon-carbon number 9 or greater contained in the toner acts as a wax dispersing auxiliary agent. Therefore, a reduction in image density caused by the deterioration of charging due to the dispersion of wax in resin, an anti-offset property, a crushing property and the filming of the wax to a developer carrying member while a low-temperature fixing property is maintained, and the occurrence of the faulty image of an object due to the filming to the image bearing member are remarkably improved. A similar effect is also obtained when the aforementioned resin is added to a magnetic developer. This aromatic hydrocarbon copolymerized petroleum resin of aliphatic hydrocarbon-carbon number 9 or greater was synthesized with diolefin and monoolefin contained in decomposed oil fraction secondary-produced from an ethylene plant for manufacturing ethylene, propylene, etc. by the steam cracking of petroleum as raw materials, and should desirably be obtained by copolymerizing at least one kind of aliphatic hydrocarbon monomer selected from among isoprene, piperylene, 2-methyl-butene-1, and 2-methyl butene-2, and at least one kind of aromatic hydrocarbon monomer selected from among vinyl toluene, α-methyl styrene, indene and isopropenyl toluene. If a pure monomer of high monomer purity is used as the aromatic hydrocarbon monomer, the odor during the coloring and heating of resin can be suppressed low and therefore, the use thereof is more preferable.

The purity of the aromatic hydrocarbon monomer should be 95% or greater, and preferably 98% or greater. The aromatic hydrocarbon monomer comprises a monomer of which the carbon number is 9 or greater, and in the case of copolymerized petroleum resin obtained from this monomer and an aliphatic hydrocarbon monomer, the solubility thereof, for example, with polyester resin becomes higher as compared with copolymerized petroleum resin obtained from an aromatic hydrocarbon monomer of which the carbon number is less than 9 and an aliphatic hydrocarbon monomer.

Further, in order to satisfy the crushability and heat preserving property of the toner, as the construction of the aromatic hydrocarbon copolymer of aliphatic hydrocarbon-carbon number 9 or greater, a greater amount of aromatic hydrocarbon monomer is preferable. However, if the amount of aromatic hydrocarbon monomer is too great, the dispersibility of a mold releasing agent will become bad, and on the other hand, if the amount of aliphatic hydrocarbon monomer is too great, the heat preserving property, etc. will be lowered and therefore, the weight ratio of the aromatic hydrocarbon monomer and the aliphatic hydrocarbon monomer is 99:1-50:50, preferably 98:2-60:40, and more preferably 98:2-90:10. Also, the amount of use thereof is 2-50 parts by weight, preferably 3-30 parts by weight, relative to 100 parts by weight of toner binding resin. If the amount of the aforementioned petroleum resin is less than 2 parts by weight, it is not effective for wax dispersion, and if it exceeds 50 parts by weight, the toner becomes liable to be excessively crushed, and the particle diameter of the toner becomes small in the developing device and fog occurs, and there is the possibility that the image density becomes low and the developing property is lowered.

Also, the degree of aggregation of the developer or the toner in the present invention is measured and calculated as follows.

Measurement was effected by the use of a powder tester produced by Hosokawa Micron Co., Ltd., and a three-stage sieve comprising a sieve of 200 meshes, a sieve of 100 meshes and a sieve of 60 meshes successively superposed one upon another. As measuring means, a powder material consisting of about 5 g of toner or developer is placed on the uppermost sieve of 60 meshes of the three-stage sieve, and a voltage of 18V is applied to the powder tester, and the degree of aggregation is calculated by the following formula from the weight ag of the powder material residual on the sieve of 60 meshes, the weight bg of the powder material residual on the sieve of 100 meshes, and the weight cg of the powder material residual on the sieve of 200 meshes when vibration having an amplitude of 0.7 mm and a vibration frequency of 50 Hz was applied to the aforedescribed sieve for 15 seconds.

$$\text{Degree of aggregation}(\%)=(a+b\times 0.6+c\times 0.2)/5$$

As the toner liable to remain on the metal plate of the blade, a degree of aggregation of 20% or greater is preferable.

Also, the object with which the photosensitive member or the cleaning blade is brought into contact should preferably have a diameter of 4-80 mm. If the diameter is smaller than 4 mm, there will arise the problem that the rigidity of the side receiving the pressure of the cleaning blade is deficient. Also, if the diameter is greater than 80 mm, the use of the cleaning blade is possible, but the possibility of using an auxiliary blade member also occurs and therefore, the effect of a smaller space which is a feature of the present invention will become less.

The other portions will be further described with reference to FIG. 1.

Primary transferring rollers 15Y, 15M, 15C and 15K are disposed at locations opposed to the photosensitive drums 12 (12Y, 12M, 12C, 12K) of the respective process units 10Y, 10M, 10C and 10K with the intermediate transferring belt 13 interposed therebetween, and a predetermined transferring bias voltage is applied to these primary transferring rollers 15Y, 15M, 15C and 15K, whereby an electric field is formed between each of the photosensitive drums 12 and each of the primary transferring rollers 15Y, 15M, 15C and 15K, and the toner images bearing charges on the photosensitive drums 12 are adapted to be transferred to the intermediate transferring belt 13 with Coulomb force. Each of the primary transferring rollers 15Y, 15M, 15C and 15K is constituted by an elastic roller of a urethane foamed material or the like with carbon dispersed therein, and the resistance value thereof is preferably of the order of $10^6$-$10^8$ Ωcm (measuring voltage: 100V). In the present embodiment, each primary transferring roller is an electrically conductive urethane sponge roller having a diameter of 18 mm and a resistance value of $5\times 10^7$ Ωcm.

On the other hand, the recording sheet P is supplied from a sheet supplying cassette 122 contained in the lower portion of a printer housing 1 to the interior of the printer housing 1, specifically a secondary transferring position in which the intermediate transferring belt 13 and the secondary transferring roller 15 contact with each other. Above the sheet supplying cassette 122, there are disposed a pickup roller 18 for drawing out the contained recording sheets P and a sheet feeding roller 19. Also, a retard roller 20 for preventing the double feeding of the recording sheets P is disposed at a location opposed to the sheet feeding roller 19.

A sheet conveying route 25 for the recording sheet P in the interior of the printer housing 1 is provided substantially vertically along the rear surface of the printer housing 1, and the recording sheet P drawn out of the sheet supplying cassette 122 located at the bottom of the printer housing 1 is moved up on this sheet conveying route 25, and is subjected to the transfer of the toner images at the aforementioned secondary transferring position, and thereafter is conveyed to a fixing device 123 provided right above the secondary transferring position. Then, the recording sheet P subjected to the fixing of the toner images by the fixing device 123 is discharged onto a sheet discharging tray 1*a* provided in the upper portion of the printer housing 1 via discharging rollers 26 in its face-down state.

The present invention will be described here with some specific examples mentioned.

EXAMPLE 1

A sheet for the cleaning blade was prepared on the basis of the composition shown below.

| | |
|---|---|
| polyester polyol (trade name: Nippolan, produced by Nippon Polyurethane Co., Ltd.) | 100 parts by weight |
| 4,4'-diphenyl methane diisocyanate (MDI) | 41 parts by weight |
| 1,4-butane diol | 6 parts by weight |

Polyester polyol was dehydrated, whereafter 4,4'-diphenyl methane diisocyanate (MDI) was mixed therewith, and the mixture was heated and reacted for 20 minutes to thereby obtain a prepolymer. 1,4-butane diol was added to this prepolymer to obtain a mixture. By the use of this mixture, a sheet-like material was made by a centrifugal making machine. This sheet had a thickness t1=2 mm and hardness of 70 degrees (JIS A), and the permanent distortion thereof was 0.5%. This sheet was cut into a predetermined size of strip, and an adhesive agent (EP-001 produced by Cemedine Co., Ltd., 100 μm) was heated and fixed at a position of 4 mm in the upper portion of a phosphate-treated steel plate (produced by Shin-Nippon Iron-Manufacturing Co., Ltd., trade name: Bonde Steel Plate) at 80° C. to thereby obtain a cleaning blade. Next,

| | |
|---|---|
| polyester polyol (trade name: Hybon, produced by Hitachi Kasei Polymer Co., Ltd.) | 100 parts by weight |
| 4,4'-diphenyl methane diisocyanate (MDI) | 30 parts by weight |
| 1,4-butane diol | 8 parts by weight |

Polyester polyol was dehydrated, whereafter 4,4'-diphenyl methane diisocyanate (MDI) was mixed therewith, and the mixture was heated and reacted at 115° C. for 20 minutes to thereby obtain a prepolymer. 1,4-butane diol was added to this prepolymer to thereby obtain a mixture. By the use of this mixture, a sheet-like material was made by a centrifugal making machine. This sheet had a thickness t3 (the thickness T (mm) in the free length direction of the blade)=1 mm and hardness of 75 degrees (JIS A), and had Young's modulus of 7 MPa and permanent distortion of 1.3%. This sheet was cut into the thickness width of the metal plate, and was stuck on the upper portion of the metal plate by an adhesive agent similar to that previously described. While in the present embodiment, the sheet which is an elastic member was adhesively secured to both of the end portion surface of the metal plate and that surface of the blade which is adjacent to the metal plate by the adhesive agent, the elastic member can be adhesively secured to at least the upper end portion surface (the end portion surface in the free end direction of the blade) of the metal plate. This is because, to prevent squat, it is necessary to generate a force which pushes the blade back when the blade is deformed, and for that purpose, at least the elastic member need be adhesively secured to the metal plate so as not to deviate relative to the metal plate. The angle between the strip-shaped sheet and the rubber layer on the upper portion of the metal plate at that time was 90°. The thickness of the metal plate and the width B of the elastic layer 3*c* were 2.0 mm.

The thus manufactured blade was deformed at its distal end by 1.7 mm, and was left in an environment of 45° C. and 90% for 5 days. After it was left in this environment, it was put into an environment of 23° C. and 60%, and the deformation of 1.7 mm was released, whereafter the amount of deformation of the distal end of the blade was measured. The amount of squat (the amount of deformation) was 2%. This blade was used in an ordinary electrophotographic machine and the test of its cleaning property was carried out, but even if 50K sheets were passed, faulty cleaning did not occur. Also, the shape of the blade was made upward and moreover, there was adopted a construction in which it is easy for the toner to collect, whereby the turning-up of the blade in a high-humidity temperature did not occur (Table 1).

EXAMPLE 2

A blade similar to Example 1 with the exception that the rubber layer on the upper portion of the metal plate was changed to the same material as the blade was manufactured.

| | |
|---|---|
| polyester polyol (trade name: Nippolan, produced by Nippon Polyurethane Co., Ltd.) | 100 parts by weight |
| 4,4'-diphenyl methane diisocyanate (MDI) | 41 parts by weight |
| 1,4-butane diol | 6 parts by weight |

This material had hardness of 70 degrees, Young's modulus of 5.3 MPa, and permanent distortion of 0.5%.

As in Example 1, the studies of the amount of squat, faulty cleaning and the turning-up of the blade were carried out. The amount of squat was 1.3% and the cleaning property was 100K or greater, and no problem arose. Any problem neither arose about the turning-up of the blade in a high-humidity environment.

EXAMPLE 3

A blade similar to Example 1 with the exception that the width of the rubber layer on the upper portion of the metal plate was covered up to the back side of the metal plate was manufactured.

As in Example 1, the studies of the amount of squat, faulty cleaning and the turning-up of the blade were carried out. The amount of squat was 1.3% and the cleaning property was 100K or greater, and no problem arose. Any problem neither arose about the turning-up of the blade in a high-humidity environment.

EXAMPLE 4

A rubber layer on the upper portion of a metal plate as an elastic member was integrally molded in advance by a mold so as to cover the width of the rubber layer up to the back side of the metal plate (the side opposite to that surface to which the blade is adhesively secured), and the integrally molded article was adhesively secured by an adhesive agent. A blade similar to Example 2 except that was manufactured.

As in Example 1, the studies of the amount of squat, faulty cleaning and the turning-up of the blade were carried out. The amount of squat was 1.4% and the cleaning property was 100K or greater, and no problem arose. Any problem neither arose about the turning-up of the blade in a high-humidity environment. As described above, the elastic member and the blade integrally molded by the mold are adhesively secured to each other by an adhesive agent and therefore, the accuracy of the position and shape of the elastic member portion can be secured. Also, the metal plate is covered up to its back side and therefore, the repulsive force of the elastic member during the deformation of the blade can be obtained, and this is more effective for the prevention of squat.

EXAMPLE 5

A blade similar to Example 2 with the exception that the material of the strip-shaped sheet in Example 2 was changed as follows was manufactured (see Table 1 for the details).

| | |
|---|---|
| polyester polyol (trade name: Hybon, produced by Hitachi Kasei Polymer Co., Ltd.) | 100 parts by weight |
| 4,4'-diphenyl methane diisocyanate (MDI) | 41 parts by weight |
| 1,4-butane diol | 10 parts by weight |

The hardness and permanent distortion of the rubber material at that time were 78 degrees and 3.0%, respectively.

As in Example 1, the studies of the amount of squat, faulty cleaning and the turning-up of the blade were carried out. Even when the hardness of the material of the blade portion was raised, the amount of squat was 1.7% and the cleaning property was 100K or greater, and no problem arose. Any problem neither arose about the turning-up of the blade in a high-humidity environment.

EXAMPLE 6

Integral molding was effected up to the upper portion of a metal plate and a strip-shaped sheet portion by the use of the following materials, and evaluation similar to that of Example 1 was effected.

| | |
|---|---|
| polycaprolactone (PCL) (trade name: Praacell, produced by Dicel Kagaku Co., Ltd.) | 50 parts by weight |
| 4,4'-diphenyl methane diisocyanate (MDI) | 40 parts by weight |
| 1,4-butane diol | 4.5 parts by weight |
| trimethylol propane (TMP) | 2.7 parts by weight |

The above-mentioned polyol (PCL) was agitated and heated at 70° C. for 3 hours, and was dehydrated, whereafter this was put into a reaction container made of glass, and subsequently MDI was added into the reaction container, and the mixture was agitated at 70° C. under a nitrogen gas atmosphere for 1 to 2 hours to thereby prepare a prepolymer.

Discretely, hardening agents (1,4-butane diol, trimethylol propane and the above-mentioned polyol) were agitated and heated at 100° C. for 1 hour, and were dehydrated, and thereafter were put into the reaction container made of glass, and were agitated and mixed at 100° C. under a nitrogen atmosphere until the mixed liquid became colorless and transparent.

Then, a pseudo-prepolymer and the hardening agents were heated to temperatures indicated by 60° C. and 40° C., respectively, were supplied to a mixing head at a ratio indicated by a weight ratio of 10:9, and were poured into a mold heated to 145° C. in advance while being mixed and agitated. The metal plate is installed in advance at a predetermined location in the mold, and the blade is directly adhesively secured to the metal plate, and is integrally molded.

The molding of the cleaning blade having the thickness 2 mm of the metal plate was effected. Then, the molded article was taken out of the mold, and was heated at 110° C. for 24 hours to thereby effect secondary hardening. As the physical properties of the obtained cleaning blade, the detailed design conditions thereof were that the thickness of the blade portion providing the cleaning performance was 2 mm, the free length was 8 mm, the thickness of the upper portion of the metal plate was t3=0.5 mm, and the width B of the metal plate in the thickness direction thereof was 2 mm. Also, the physical properties of the material of that portion were such that the hardness of both of the cleaning portion for integral molding and the rubber of the upper portion of the metal plate was 71 degrees (JIS A), the Young's modulus was 6.1 MPa and permanent distortion was 0.4%. The angle between this strip-shaped sheet and the rubber layer on the upper portion of the metal plate was 90°.

This manufactured blade was deformed by 1.7 mm at its distal end, and was left in an environment of 45° C. and 90% for 5 days. After it was left in that environment, it was put into an environment of 23° C. and 60%, and the deformation of 1.7 mm was released, whereafter the amount of deformation of the distal end of the blade was measured. The amount of squat (the amount of deformation) was 0.5%. This blade was used in an ordinary electrophotographic machine and the test of the cleaning property was carried out, but even if 50K sheets were passed, faulty cleaning did not occur. Also, by adopting a construction in which the shape of the blade is upward and moreover, it is easy for the toner to collect, the turning-up of the blade in a high-humidity environment neither occurred.

As in the present example, the metal plate, the blade and the elastic member are integrally molded by a mold, whereby the accuracy of the shape of the elastic member is secured and yet, the elastic member can be adhesively secured to the distal end portion of the metal plate. Also, because of a construction in which the blade itself is directly secured to the metal plate without an adhesive material interposed therebetween, the shortening of the working process can be achieved. Also, discretely the adhesive agent can be made unnecessary.

COMPARATIVE EXAMPLE 1

A blade similar to Example 1 with the exception that the layer on the upper portion of the metal plate in Example 1 is not formed was manufactured.

As in Example 1, the studies of the amount of squat, faulty cleaning and the turning-up of the blade were carried out. The amount of squat was as great as 15.0%, and the cleaning property was of the order of 12K, and faulty cleaning occurred. Regarding the turning-up of the blade in a high-humidity environment, no problem arose.

COMPARATIVE EXAMPLE 2

A blade similar to Example 1 with the exception that the layer on the upper portion of the metal plate in Example 5 is not formed was manufactured.

As in Example 1, the studies of the amount of squat, faulty cleaning and the turning-up of the blade were carried out. The amount of squat was as great as 20.0%, and regarding the cleaning property, faulty cleaning occurred at the order of 5K. Regarding the turning-up of the blade in a high-humidity environment, no problem arose.

COMPARATIVE EXAMPLE 3

A blade similar to Example 1 with the exception that the thickness B of the rubber layer on the upper portion of the metal plate in the thickness direction of the metal plate is 1.0 mm was manufactured.

As in Example 1, the studies of the amount of squat, faulty cleaning and the turning-up of the blade were carried out. The amount of squat was considerably good, but was 7.5%, and the cleaning property was of the order of 20K and faulty cleaning occurred. Regarding the turning-up of the blade in a high-humidity environment, no problem arose.

COMPARATIVE EXAMPLE 4

A blade similar to Example 4 with the exception as in Example 4, the upper portion of the metal plate is made by a mold and at that time, the set angle with respect to the strip portion of the blade is 150° was manufactured.

As in Example 1, the studies of the amount of squat, faulty cleaning and the turning-up of the blade were carried out. Regarding the amount of squat, the rubber layer on the upper portion of the metal plate was non-uniform and therefore the force pushing by the surface was weak, and the amount of squat was 5.0%. The cleaning property was of the order of 30K and faulty cleaning occurred. In the construction of only this blade, the turning-up of the blade occurred at 5K in a high-humidity environment.

COMPARATIVE EXAMPLE 5

A blade similar to Example 1 with the exception that the thickness of the rubber material on the upper portion of the metal plate is 1.4 mm was manufactured. This material had hardness of 70 degrees, Young's modulus of 7 MPa and permanent distortion of 1.3%.

As in Example 1, the studies of the amount of squat, faulty cleaning and the turning-up of the blade were carried out. The amount of squat was 3.5% and the cleaning property was 50K or greater and no problem arose, but yet correspondingly to the increase in the thickness at this Young's modulus, the relationship (formula 1) between the Young's modulus and the thickness t3 of the elastic layer was not satisfied, and the flexibility of the blade was lost and faulty cleaning occurred.

TABLE 1

| | | Example 1 | Example 2 | Example 3 | Example 4 | Example 5 |
|---|---|---|---|---|---|---|
| main components of the material of the blade | polyester polyol | 100 parts by wt. | 100 parts by wt. | 100 parts by wt. | 100 parts by wt. | 100 parts by wt. |
| | 4,4'-diphenyl methane diisocyanate (MDI) | 41 parts by wt. | 41 parts by wt. | 41 parts by wt. | 41 parts by wt. | 41 parts by wt. |
| | 1,4-butane diol | 6 parts by wt. | 6 parts by wt. | 6 parts by wt. | 6 parts by wt. | 10 parts by wt. |
| | hardness | 70° | 70° | 70° | 70° | 70° |
| | permanent distortion | 0.50% | 0.50% | 0.50% | 0.50% | 3.00% |
| rubber (resin) material on the upper portion of metal plate | polyester polyol | 100 parts by wt. | 100 parts by wt. | 100 parts by wt. | 100 parts by wt. | 100 parts by wt. |
| | 4,4'-diphenyl methane diisocyanate (MDI) | 30 parts by wt. | 41 parts by wt. | 30 parts by wt. | 41 parts by wt. | 41 parts by wt. |
| | 1,4-butane diol | 6 parts by wt. | 6 parts by wt. | 8 parts by wt. | 6 parts by wt. | 6 parts by wt. |
| | hardness | 75° | 70° | 75° | 70° | 70° |
| | Young's module | 7 MPa | 5.3 MPa | 7 MPa | 5.3 MPa | 5.3 MPa |
| | permanent distortion | 1.30% | 0.50% | 1.30% | 0.50% | 0.50% |
| | thickness | 1 mm | 1 mm | 1 mm | 1 mm | 1 mm |
| | width | 2 mm | 2 mm | 2 mm | 2 mm | 2 mm |
| | angle with strip-shaped blade | 90° | 90° | 90° | 90° | 90° |
| | presence or absence of layer up to the back side of metal plate | absent | absent | present | present | present |
| thickness of metal plate | | 2 mm | 2 mm | 2 mm | 2 mm | 2 mm |
| amount of squat | | 2.5% | 3.5% | 1.3% | 1.4% | 1.7% |
| Number of endurable sheets at which faulty cleaning occurs | | 50K sheets or more | 50K sheets or more | 100K sheets or more | 100K sheets or more | 100K sheets or more |
| turning-up of blade | | absent | absent | absent | absent | absent |

| | | Comparative Example 1 | Comparative Example 2 | Comparative Example 3 | Comparative Example 4 |
|---|---|---|---|---|---|
| main components of the material of the blade | polyester polyol | 100 parts by wt. | 100 parts by wt. | 100 parts by wt. | 100 parts by wt. |
| | 4,4'-diphenyl methane diisocyanate (MDI) | 41 parts by wt. | 41 parts by wt. | 41 parts by wt. | 41 parts by wt. |
| | 1,4-butane diol | 6 parts by wt. | 10 parts by wt. | 6 parts by wt. | 6 parts by wt. |
| | hardness | 70° | 70° | 70° | 70° |
| | permanent distortion | 0.50% | 3.00% | 0.50% | 0.50% |
| rubber (resin) material on the upper portion of metal plate | polyester polyol | | | 100 parts by wt. | 100 parts by wt. |
| | 4,4'-diphenyl methane diisocyanate (MDI) | | | 30 parts by wt. | 30 parts by wt. |
| | 1,4-butane diol | | | 8 parts by wt. | 8 parts by wt. |
| | hardness | | | 75° | 75° |
| | Young's module | | | 7 MPa | 7 MPa |
| | permanent | | | 1.30% | 1.30% |

TABLE 1-continued

| | | | | | |
|---|---|---|---|---|---|
| | distortion | | | | |
| | thickness | | | 1 mm | 1 mm |
| | width | | | 1 mm | — |
| | angle with strip-shaped blade | | | 90° | 150° |
| | presence or absence of layer up to the back side of metal plate | | | absent | absent |
| thickness of metal plate | | 2 mm | 2 mm | 2 mm | 2 mm |
| amount of squat | | 15.0% | 20.0% | 7.5% | 5.0% |
| Number of endurable sheets at which faulty cleaning occurs | | faulty cleaning for 12K | faulty cleaning for 5K | faulty cleaning for 20K | faulty cleaning for 30K |
| turning-up of blade | | absent | absent | absent | turned up for 5K in high humidity environment |

This application claims priority from Japanese Patent Application No. 2004-247951 filed Aug. 27, 2004, which is hereby incorporated by reference herein.

What is claimed is:

1. A cleaning apparatus comprising:

a plate-shaped cleaning blade contacting with an image bearing member for removing toner on said image bearing member;

a supporting member for supporting said cleaning blade on a supporting surface at a side opposed to said image bearing member; and an elastic member that is provided on a distal end portion of said supporting member at a contacting side where said cleaning blade contacts said image bearing member, and that contacts said cleaning blade;

wherein a length L (mm) of said elastic member in a direction toward a contact region where said cleaning blade contacts said image bearing member and a Young's modulus Y (MPa) of said elastic member have the following relationships:

$$-0.033Y+0.5 \leqq L \leqq -0.055Y+1.6, \text{ and } 3 \leqq Y \leqq 12.$$

2. A cleaning apparatus according to claim 1, wherein when a thickness of said elastic member in a direction vertical to said supporting surface is defined as B (mm), and $1.6 \leqq B \leqq 2.5$.

3. A cleaning apparatus according to claim 1, wherein said elastic member is adhered to both of a surface of said distal end portion and an opposite surface of said supporting member which is opposite to a surface opposed to said image bearing member.

4. A cleaning apparatus according to claim 1, wherein said elastic member is formed of the same material as said cleaning blade.

5. A cleaning apparatus according to claim 1, wherein a free length of said cleaning blade is 3 mm or greater and 15 mm or less.

6. A cleaning apparatus according to claim 1, wherein a thickness of said cleaning blade is 1.5 mm or greater and 4 mm or less.

7. A cleaning apparatus according to claim 1, wherein an angle between a surface of said elastic member and a surface of said cleaning blade is 100 degrees or less.

8. A cleaning apparatus according to claim 1, wherein the Young's modulus is 5 MPa or greater and 8 MPa or less.

9. A cleaning apparatus comprising:

a cleaning blade contacting with an image bearing member for removing toner on said image bearing member; and a supporting member having a first surface at a side opposed to said image bearing member, for supporting said cleaning blade which is adhered to at least said first surface and a second surface of said supporting member substantially vertical to said first surface, wherein said cleaning blade includes a part adhered to said second surface, and a length L (mm) of said part of said cleaning blade in a direction vertical to said second surface and the Young's modulus Y (MPa) of said cleaning blade, have the following relationship:

$$-0.033Y+0.5 \leqq L \leqq -0.055Y+1.6, \text{ and } 3 \leqq Y \leqq 12.$$

10. A cleaning apparatus according to claim 9, wherein a length of said cleaning blade from said first surface in a direction vertical to said first surface is defined as B (mm), and $1.6 \leqq B \leqq 2.5$.

11. A cleaning apparatus according to claim 9, wherein said supporting member is covered up to its surface opposite to its surface opposed to said cleaning blade with an elastic member.

12. A cleaning apparatus according to claim 9, wherein an elastic member is formed of the same material as said cleaning blade.

13. A cleaning apparatus according to claim 9, wherein a free length of said cleaning blade is 3 mm or greater and 15 mm or less.

14. A cleaning apparatus according to claim 9, wherein a thickness of said cleaning blade is 1.5 mm or greater and 4 mm or less.

15. A cleaning apparatus according to claim 9, wherein an angle between a surface of said elastic member and a surface of said cleaning blade is 100 degrees or less.

16. A cleaning apparatus according to claim 9, wherein the Young's modulus is 5 MPa or greater and 8 MPa or less.

* * * * *

UNITED STATES PATENT AND TRADEMARK OFFICE

CERTIFICATE OF CORRECTION

PATENT NO. : 7,289,759 B2
APPLICATION NO. : 11/206267
DATED : October 30, 2007
INVENTOR(S) : Motohiro Ogura It is certified that error appears in the above-identified patent and that said Letters Patent is hereby corrected as shown below:

IN THE DRAWINGS:

At Sheet 6, FIG. 7, both occurrences, "YOUNG'S MODULE" should read --YOUNG'S MODULUS--.

COLUMN 1:

Line 33, "apace" should read --space requirement--.

COLUMN 3:

Line 47, "arrow" should read --the arrows--.

COLUMN 6:

Line 42, "becomes" should read --will become--;
Line 45, "becomes" should read --will become--;
Line 60, "$-0.033Y+0.5 \leq T \leq -0.055Y+1.6 (3 \leq Y \leq 12)$" should read --$0.033Y+0.5 \leq L \leq -0.055Y+1.6$ and $(3 \leq Y \leq 12)$--; and
Line 66, "thickness T" should read --length L--.

COLUMN 7:

Line 4, "lenght L (mm)" should read --length L (mm)--;
Line 11, "lenght L (mm)" should read --length L (mm)--.
Line 35, "he" should read --the--.

COLUMN 12:

Line 35, "neither arose about" should read --did not arise regarding--;
Line 66, "neither arose about" should read --did not arise regarding--.

Signed and Sealed this

First Day of July, 2008

JON W. DUDAS
*Director of the United States Patent and Trademark Office*